US005460596A

United States Patent [19]

Brady

[11] Patent Number: 5,460,596

[45] Date of Patent: Oct. 24, 1995

[54] METHOD AND APPARATUS FOR STRETCHING TIGHT MUSCLES

[76] Inventor: Thomas L. Brady, 54 Wakefiled St., Hamden, Conn. 06512

[21] Appl. No.: 205,120

[22] Filed: Mar. 3, 1994

[51] Int. Cl.[6] ..... A61H 1/02

[52] U.S. Cl. ..... 601/35; 601/27; 482/79; 482/907

[58] Field of Search ..... 482/79, 80, 907; 601/27, 29, 31, 32, 33, 34, 35

[56] References Cited

U.S. PATENT DOCUMENTS

| | | | |
|---|---|---|---|
| 4,905,677 | 3/1990 | Pecheux | 601/35 |
| 4,953,541 | 9/1990 | Parker, Jr. | 601/35 |
| 4,986,261 | 1/1991 | Iams et al. | 601/35 |
| 5,122,106 | 6/1992 | Atwood et al. | 482/80 |
| 5,123,916 | 6/1992 | Riddle et al. | 606/243 |
| 5,277,681 | 1/1994 | Holt | 482/907 |
| 5,328,426 | 7/1994 | Vendette | 482/907 |
| 5,352,185 | 10/1994 | Blauth et al. | 482/79 |

*Primary Examiner*—Richard J. Apley
*Assistant Examiner*—Jeanne M. Clark
*Attorney, Agent, or Firm*—Evelyn M. Sommer

[57] ABSTRACT

Method and apparatus are provided for stretching tight muscles. The apparatus includes a base; a leg carriage pivotally mounted at one end to the base and adapted to receive and hold at least one leg of a user during use of the device; and a drive motor for causing the leg carriage to pivot at the one end relative to the base and cause the opposite end of the carriage to alternately raise and lower to thereby stretch the leg of the user.

14 Claims, 3 Drawing Sheets

METHOD AND APPARATUS FOR STRETCHING TIGHT MUSCLES

BACKGROUND OF THE INVENTION

1. Field of the Invention

The present invention relates generally to a method and apparatus for stretching tight muscles and, more specifically, to such method and apparatus which employs a motor-driven orthopedic device which is adapted to stretch and exercise an individual's leg and hip muscles, particularly the hamstring muscle.

The increasing number of people involved in regular physical exercise has led to a corresponding increase in the number of sports-related injuries, particularly to the legs and lower joints. This, in turn, has led to a greater number of people seeking physical therapy for treatment of these injuries. In addition, many athletes recognize that proper stretching before and after prolonged periods of exercise will increase athletic performance, help prevent injury and keep sore muscles from tightening.

It is common knowledge that stretching tight muscles is one of the most important means of treating athletic, neurological or orthopedic injuries to the legs. Stretching helps promote flexibility, increases the range of motion and therefore minimizes the chances of re-injuring the injured limb. However, it is also important that proper stretching techniques be used in order to achieve the maximum benefits and prevent additional injury during the stretching process. In order to achieve the maximum benefits, stretching should be done in a slow, gradual fashion, with the limb stretched only so far as it can go without discomfort. The stretch should be maintained at the maximum level for a few seconds and then the tension relaxed. This should then be repeated several times for maximum benefit. It is important that the stretch be maintained without bouncing, which can itself cause further injuries.

Further, proper leg stretching requires that the muscles of the lower back be kept as stable as possible. This both avoids straining the lower back muscles and focuses on the limb involved.

2. Description of the Prior Art

Physical therapy devices for exercising and stretching leg muscles have been used for a number of years. For example, U.S. Pat. No. 4,637,379, which issued to Saringer, is directed to a device for imparting continuous passive motion to leg joints whereby a reclining patient's leg is extended to an elevated foot rest. A motor is provided for moving the footrest in a longitudinal reciprocal stroke, so as to provide slow, rhythmic and continuous movement of a leg joint, such as a knee, to the exclusion of the ankle, or vice versa.

U.S. Pat. No. 5,035,233, which issued to Ruf, is directed to a motor driven frame which utilizes a threaded spindle to drive a foot support carriage to provide an orthopedic exercise for a leg joint.

U.S. Pat. No. 5,122,106, which issued to Atwood et al., is also directed to a stretching apparatus which includes a base structure for supporting an individual in a supine position. A cradle is provided which is designed to accommodate one leg. The cradle can be pivoted about an axis in order to provide a stretch to the limb.

While these patents all teach various forms of such physical therapy devices which can be used to stretch one's limbs, they are quite complicated in structure and do not provide means for regulated stretching as may be found in the instant invention.

SUMMARY OF THE INVENTION

Against the foregoing background, it is a primary object of the present invention to provide a method and apparatus for stretching tight muscles.

It is another object of the present invention to provide a motor-driven orthopedic device which may be used for stretching and therapeutic treatment of the leg and hip joint.

It is yet another object of the present invention to provide a device whereby stretching can be accomplished in a slow, gradual fashion, and where the patient may control the amount of stretch by means of a hand control unit.

It is still another object of the present invention to provide a stretching device that is safe and simple to operate, and yet is inexpensive to own.

It is still yet another object of the present invention to provide a stretching device that is capable of being used for either or both the right and left leg with only minor adjustment being required.

It is yet still a further object of the present invention to provide a device which may be used in either the standing or supine positions.

To the accomplishments of the foregoing objects and advantages, the present invention, in brief summary, comprises a method and apparatus for use in stretching tight muscles that can give the athlete the maximum benefits from stretching while minimizing the potential risk of injury. While there are other orthopedic exercise frames in use, most are either complicated to use or are too cumbersome and/or expensive to be found at any place other than the office of a physician or physical therapist. Thus, the instant invention can properly stretch one's limbs while being both safe and simple to operate.

In addition, the instant invention is also so easy to operate that an individual could have one in a home or office, or anywhere with a power source such as electrical outlet. A battery could be used a power source as well, making it even more portable. Thus, an injured athlete can continue his rehabilitation without having to go to the office of a doctor or physical therapist.

Another feature of the instant device is that it can be used for either or both the right and left leg with only minor adjustment of the patient's position being required.

The stretch produced by the apparatus of the instant invention is regulated by the patient or operator to the patient's discomfort level. In use, with the patient in a supine position, the patient's leg is immobilized in the leg carriage. Then, by operation of an electric motor connected to a simple hand switch, the patient's leg can be passively stretched by moving it in a range of motion that provides tension to the soft tissues of the lower extremities, while elevating the leg to the proper angle and maintaining the stretch for a predetermined length of time.

Thus, the stretching of the hamstring or calf muscle is carried out without any involvement of the lower back muscles. The hand switch therefore gives the user full control of the degree and duration of the stretch.

BRIEF DESCRIPTION OF THE DRAWINGS

The above and other objects, features and advantages of the present invention will become apparent from the following detailed description of the accompanying drawings in which.

DETAILED DESCRIPTION OF THE INVENTION

Figure 1:
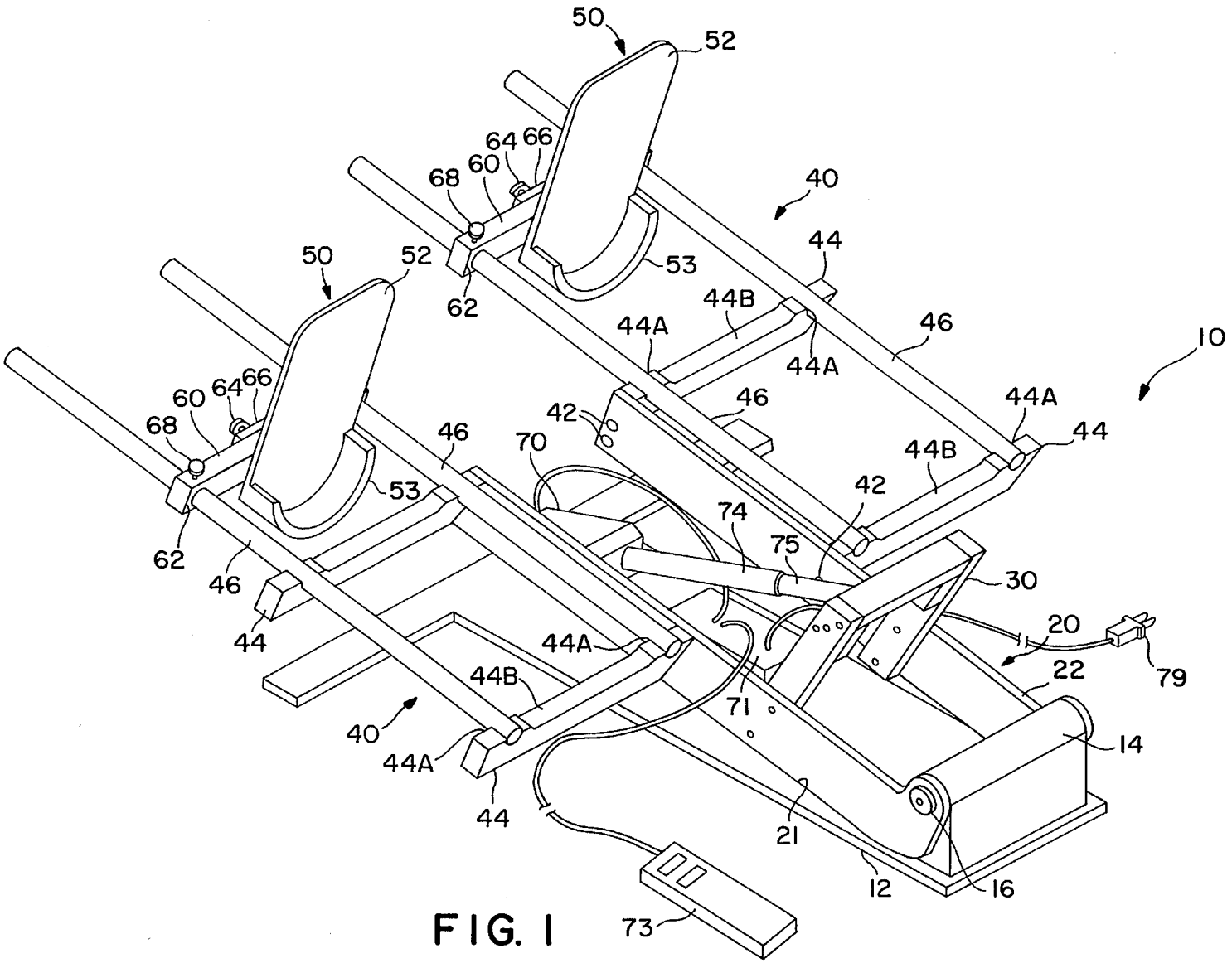
FIG. 1 is a front perspective view of the an embodiment of the device of the present invention mounted for use in a supine position.
Figure 2:
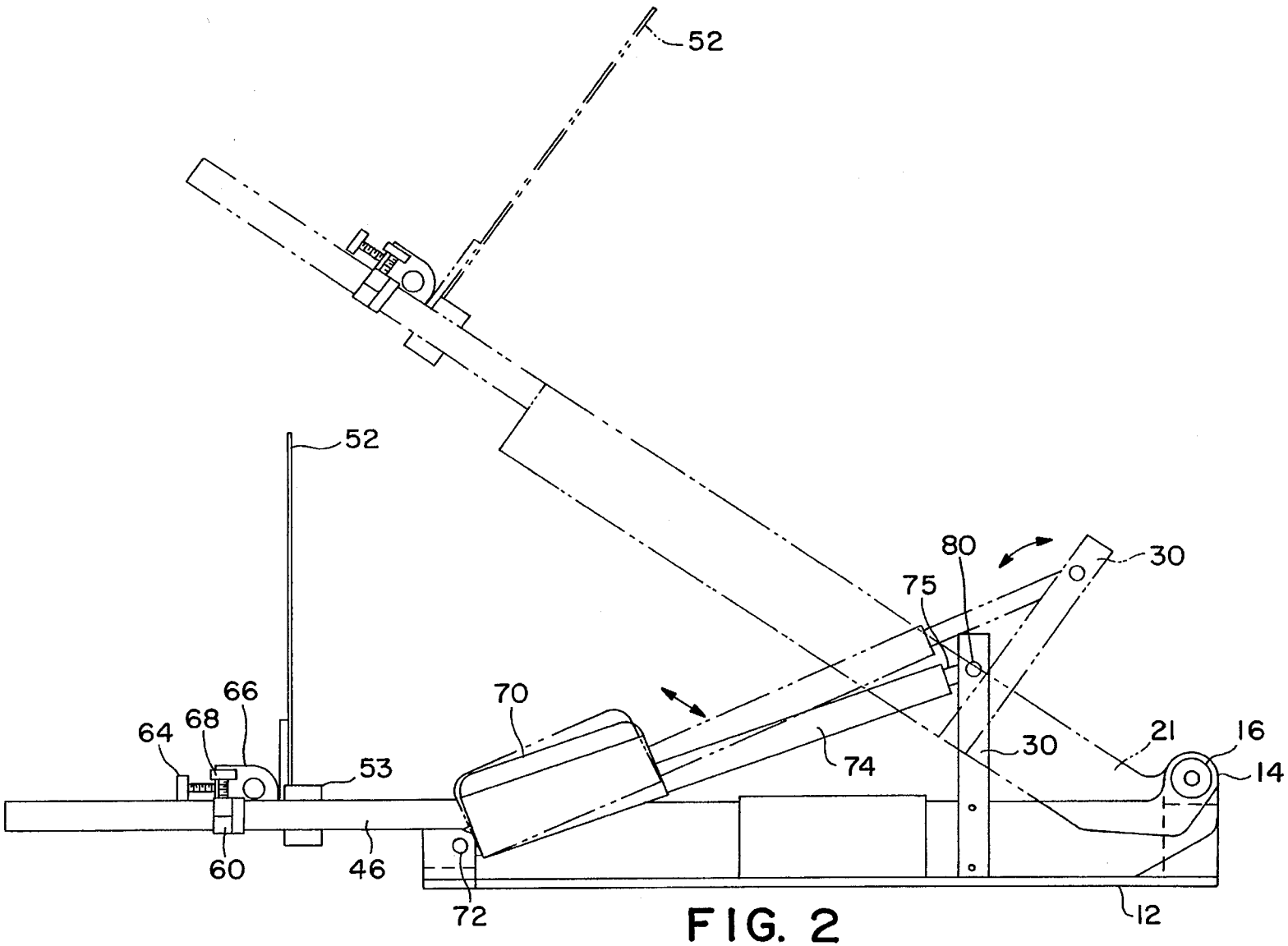
FIG. 2 is a side view of the device of FIG. 1 illustrating the range of motion of the device of FIG. 1.

Referring to the drawings and, in particular, to FIGS. 1–2 thereof, the orthopedic stretching device of the present invention, referred to generally by reference numeral 10, includes a T-shaped base 12 to which is pivotally mounted a leg carriage 20 by pivot element 14. Pivot element 14 is particularly adapted to permit the leg carriage 20 to pivot about the base 12 and move in a longitudinal arc relative thereto.

The leg carriage 20 includes a pair of opposed and parallel side arms 21 and 22 which extend outwardly from the end pivotally mounted to the base 12. Apertures (not shown) are provided at such ends of the side arms 21 and 22 and are adapted to receive a pivot rod or bolt 16 for pivotally mounting the leg carriage 20 to the pivot element 14.

A U-shaped support brace 30 is provided between the side arms 21 and 22 and is fastened thereto by the use of bolts or other fastening devices.

Leg supports 40 are provided on and secured to the outer sides of side arms 21 and 22 by bolts or other fastening devices 42. Leg supports 40 each include a pair of calf support brackets 44 which are secured to the outer surfaces of side arms 21 and 22 by the fastening devices 42. Leg supports 40 each include a pair of laterally spaced parallel rails 46 which extend horizontally, in a direction parallel to side walls 21 and 22 and which are maintained in position by the calf support brackets 44 which include cut-out portions 44A for receiving and retaining the rails 46 and a concave center portion 44B which is adapted to conform to the calf portion of the user's leg.

Adjustable foot supports 50 are provided at the outward end of both leg supports 40 and are adapted to receive, hold and support the user's feet during operation of the stretching device 10. The foot supports 50 each include a vertically extending sole plate 52 with a heel support 53 extending at a right angle thereto for supporting the foot of the user.

The sole plate 52 is adjustably secured to a foot support bracket 60 which is slideably mounted on rails 46 which pass through apertures 62 contained thereon. The particular angle of the sole plate 52 relative to the rails 46 is adjusted by an adjusting screw 64 and adjusting plate 66 provided on the foot support bracket 60. Similarly, the position of the sole plate 52 along the parallel rails 46 may be adjusted by the use of adjustable locking screws 68 which are provided at both ends of the foot support bracket 60. This is illustrated in FIG. 1 in which the two sole plates 52 are shown at different places along the parallel rails 46.

Figure 3:
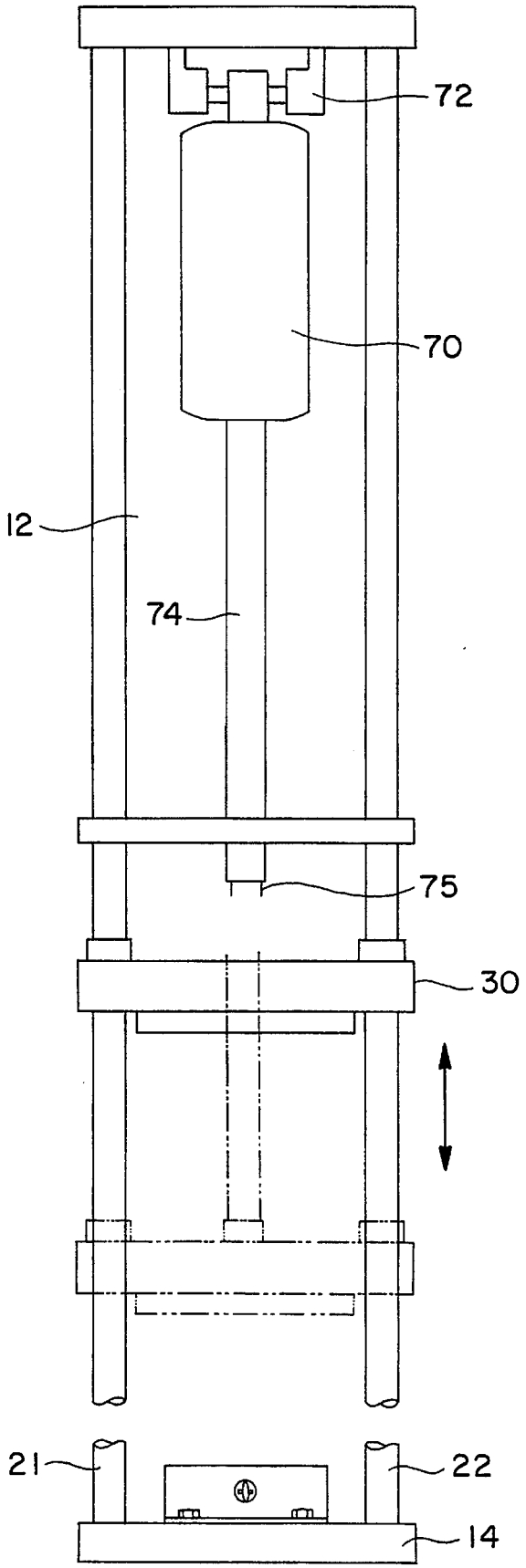
FIG. 3 is an enlarged sectional view of the drive system used in the apparatus of the present invention.

As best shown in FIG. 3, a drive system is provided which includes a drive element 70 which is powered by a motor 71. The drive element 70 is pivotally mounted to the base 12 by pivot mount 72 and is adapted to drive the leg carriage 20 in a longitudinal arc while itself being rotatable in an opposite arc. An extendable drive shaft 74 and extension arm 75 extend from the drive element 70 and are pivotally secured at the end of the extension arm 75 to a pivot mount 80 provided on the U-shaped support brace 30. A remote control 73 with at least an "Up" and "Down" switch is provided for controlling the motor 71 and, thereby, the position of the leg carriage 20. An external plug 79 is provided to obtain electrical power for the motor.

As depicted in FIG. 3, when the drive element 70 is activated by the patient or clinician using the remote control 73, the drive shaft 74 and extension arm 75 are forced in a direction toward the U-shaped brace 30 of the leg carriage 20. This causes the leg carriage 20 to pivot about hinge 16 and thereby raising the leg carriage 20 relative to the base 12. Similarly, when the user wants to lower the leg carriage, using the remote control 73, the drive element 70 retracts the drive shaft 74 and extension arm 75 which correspondingly will lower the leg carriage 20 to a reclining position.

It will, of course, be appreciated that the motor 71 can be either an electrical or battery powered motor. In the preferred embodiment, the frame and the leg carriage should be made out of a lightweight but sturdy material such as aluminum, a weight steel or a sturdy thermoplastic material. This would insure that the device is sturdy, but also affordable and easy to carry.

The actual operation of the apparatus of the present invention is relatively simple. The apparatus is initially connected to a power source by plugging power cord 79 into a normal electrical outlet, or alternatively, employing battery power. The patient would then recline on the floor next to the device, with the leg carriage 20 placed at its lowest position. The individual would then insert one or both legs into the leg carriages 20 placing his foot or feet into the adjustable foot supports 50. He would then adjust the position of the foot supports 50 along the lateral rails 46 in order to accommodate his leg at the required length and, if necessary, adjust the angle of sole plate 50 using adjusting screw 64.

The patient will then recline totally, thereby stabilizing his or her spine. Then, by manipulating the switch on hand control unit 73, the patient will activate the motor 71 and drive element 70, causing the leg carriages 40 to be elevated to the proper degree so as to provide a stretch to the patient's leg and/or hamstring muscle while keeping the leg straight and the spine stabilized. Once the maximum stretch is achieved, the patient need only remove his finger from the control device 73 to maintain the stretch at the desired level. Then, the patient would simply depress the "down" control on the hand control in order to lower the leg to a position of rest.

In an alternative embodiment not depicted in the drawings, the device of the present invention may be raised to a vertical position in order to allow a user to stretch his leg from a standing position. This would be accomplished by simply mounting base 12 on a support brace in a vertical position.

Having thus described the invention with particular reference to the preferred forms thereof, it will be obvious that various changes and modifications may be made therein without departing from the spirit and scope of the invention as defined by the appended claims.

Wherefore, I claim:

1. An orthopedic exercise device, comprising:

a base;

a leg carriage pivotally mounted at a pivot end to said base and having at least one leg support mounted thereon to receive and support at least one leg of a user during use of said device, said leg support being configured to only support the calf and foot of the user leaving the thigh of the user unrestricted, wherein said leg carriage comprises two parallel arms extending from the pivot end of the carriage and said leg support is attached parallel to at least one of the parallel arms at an intermediate point on said at least one arm; and drive means for causing said leg carriage to pivot about said pivot end relative to said base and cause the opposite end of said leg carriage to alternately raise and lower so as to stretch the leg of the user, said drive means comprising a motor-driven drive shaft pivotally mounted to the base and an extension arm having one end telescopically received by the drive shaft and an opposite end pivotally mounted to a bracket means connected to the parallel arms of the leg carriage.

2. The device of claim 1, wherein said at least one leg support includes:

at least one support bracket secured to said leg carriage; and a pair of opposed rails mounted on said at least one support bracket and adapted to receive and hold the leg of a user.

3. The device of claim 2, wherein said at least one leg support further includes an adjustable foot support.

4. The device of claim 3, wherein said foot support includes a foot support bracket slidably mounted on said pair of opposed rails and locking means for locking the foot support bracket at a desired location of said foot support on said opposed rails.

5. The device of claim 3, wherein said foot support further comprises:

a sole plate with a curvilinear heel portion in a substantially perpendicular angle to said rails and adapted to receive and hold the foot of the user;

a foot support bracket adjustably secured to said sole plate and slidably mounted on said opposed rails; and means for adjusting the position of said foot support along said opposed rails.

6. The device of claim 5, wherein said foot support includes means for adjusting a particular angle of said foot support relative to the opposed rails.

7. The device of claim 1, wherein said drive means comprises:

a motor.

8. The device of claim 7, wherein said bracket means includes a U-shaped support bracket to which said extension arm is pivotally connected.

9. The device of claim 7, wherein said motor is an electric motor.

10. The device of claim 7, wherein said motor is controlled by means of a remote control switch.

11. An orthopedic exercise device, comprising:

a base;

a leg carriage pivotally mounted at a pivot end to said base and having at least one leg support secured thereto to receive and support at least one leg of a user during use of said device, said leg support being configured to only support the calf and foot of the user leaving the thigh of the user unrestricted, wherein said leg carriage includes a pair of parallel arms extending outwardly from said pivot end pivotally mounted to said base, wherein said at least one leg support includes:

at least one support bracket secured to said leg carriage;

a pair of opposed rails mounted on said at least one support bracket and adapted to receive and hold the leg of a user; and an adjustable foot support including a foot support bracket slidably mounted on said pair of opposed rails, and means for adjusting the position of said foot support bracket along said rails; and drive means for causing said leg carriage to pivot at said pivot end relative to said base and cause the opposite end of said leg carriage to alternately raise and lower so as to stretch the leg of the user, wherein said drive means comprises a motor and a drive element pivotally mounted to said base, said drive element being powered by an output of said motor and having a drive shaft and an extension arm which has one end telescopically received by the drive shaft and an opposite end pivotally secured to said leg carriage for causing said leg carriage to alternately raise and lower.

12. The device of claim 7, wherein said foot support further comprises:

a sole plate with a curvilinear heel portion mounted in a substantially perpendicular angle to said rails and adapted to receive and support the foot of the user;

wherein said foot support bracket is adjustably secured to said sole plate and slidably mounted on said opposed rails.

13. The device of claim 8, wherein said motor is an electric motor.

14. The device of claim 8, wherein said motor is controlled by means of a remote control switch.

* * * * *